US005540381A

United States Patent [19]

Davis

[11] Patent Number: 5,540,381

[45] Date of Patent: Jul. 30, 1996

[54] SLEEVE FOR DISPLAYING A CONTAINER

[75] Inventor: Martha Davis, New York, N.Y.

[73] Assignee: BC-USA, New Holland, Pa.

[21] Appl. No.: 387,574

[22] Filed: Feb. 13, 1995

[51] Int. Cl.[6] ..... B65D 5/04

[52] U.S. Cl. ..... 229/103.2; 206/434; 206/485.1

[58] Field of Search ..... 229/103.2; 206/485.1, 206/485, 434

[56] References Cited

U.S. PATENT DOCUMENTS

| | | | |
|---|---|---|---|
| 3,443,681 | 5/1969 | Wysocki | 206/485.1 |
| 3,701,181 | 10/1972 | Lock | 206/434 X |
| 3,773,170 | 11/1973 | Rossi | 206/485.1 |
| 4,407,414 | 10/1983 | Rey et al. | 229/103.2 |
| 4,570,796 | 2/1986 | Groom | 229/103.2 |
| 4,611,754 | 9/1986 | Sutherland | 206/485.1 X |
| 4,671,453 | 6/1987 | Cassidy | 206/485.1 |
| 5,000,313 | 3/1991 | Oliff | 206/434 |
| 5,092,467 | 3/1992 | Elward | 229/103.2 |
| 5,311,984 | 5/1994 | Harris | 206/434 |

*Primary Examiner*—Allan N. Shoap
*Assistant Examiner*—Christopher J. McDonald
*Attorney, Agent, or Firm*—Vickers, Daniels & Young

[57] ABSTRACT

A paperboard blank is disclosed which is formable into a sleeve for holding a tub shaped container. The sleeve includes top and bottom walls generally corresponding to the lid and bottom wall of the container, side walls adjacent the side wall of the container and having cutouts for engaging the container lid, and an angled strip between the bottom wall and one side wall. The cutouts and angled strip hold the container in place in the sleeve.

5 Claims, 6 Drawing Sheets

FIG. 1
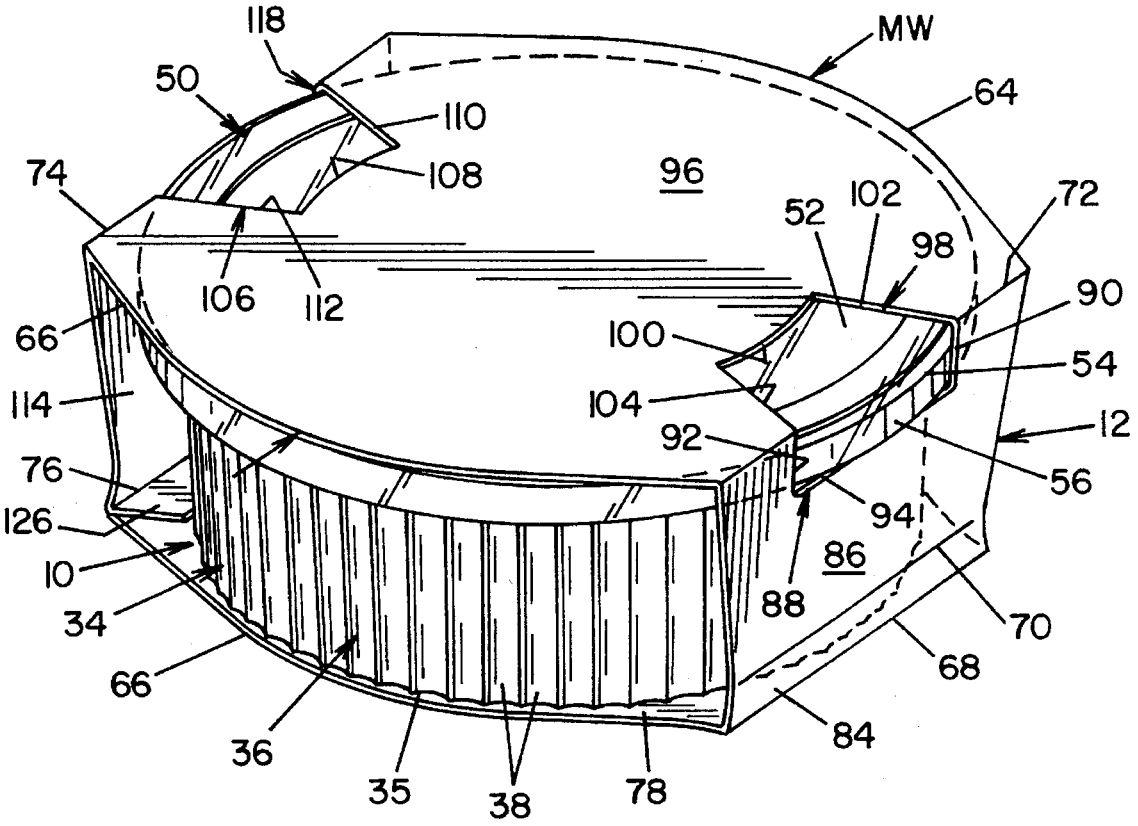
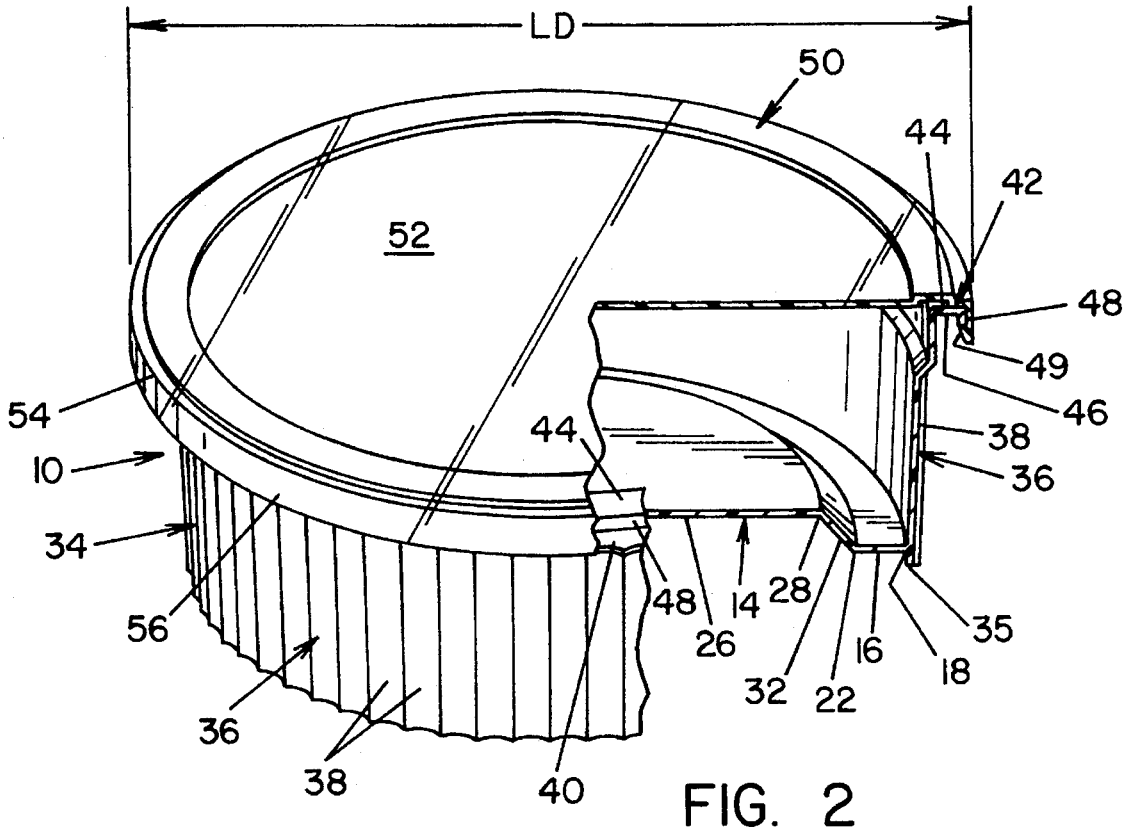
FIG. 2

SLEEVE FOR DISPLAYING A CONTAINER

The present invention is directed toward a holder for a container and, more specifically, toward a sleeve for holding and displaying a generally tub-shaped container.

BACKGROUND OF THE INVENTION

There are many types of containers in use for storing and displaying small objects or small quantities of material and many of these containers are used in connection with food products. One common container type has a wide, open top, a relatively shallow annular side wall which may be fluted or otherwise irregularly contoured, includes a removable lid and is often made of plastic. Such containers are frequently used to store dairy products such as sour cream, cheese, or butter; deli products such as egg salad; or bulk products such as rice or beans. Frequently, these containers include clear lids so that the product therein can be viewed from without. Sometimes an opaque lid having writing on it is used, or an information bearing label may be placed on the lid. Such containers are referred to hereinafter as "tubs." Because it is more difficult to print on plastic and/or on the annular side wall of such containers whether irregularly shaped or not, producers who market their products in plastic tubs are often limited in the nature of designs and colors that can economically be used to label such goods.

Regardless of the method of displaying information, the most visible, and hence, most useful surface of the container for displaying information is the lid. The lid is easily viewed by a prospective purchaser when the product rests on its base. The sides of the container are often narrow and sometimes angled and are less suitable for displaying information. The container bottom, besides being normally hidden, often has ridges or other features which result from the manufacturing process and may include a depression to increase the strength of the container. All of these problems make the container lid the location of choice for displaying product information.

Additionally, new nutritional labeling requirements mandate that certain information be displayed in a prominent manner. Such prominent displays take away from the space remaining for other marketing information. Furthermore, because the food product comes in contact with all interior surfaces of the container, the purchaser is unlikely to desire to cut portions from the container which bear recipes or coupons because these portions will be covered with the food product. Nor is it desirable to place coupons within the container with a product such as sour cream or cheese. It would be beneficial to package food products which are most economically sold in tubs in a manner that avoids the aforementioned problems without losing the economies associated with selling these products in tubs.

SUMMARY OF THE INVENTION

These problems and others are overcome by the present invention which comprises a sleeve adapted to fit around a tub-shaped container and stay firmly fastened in place thereabout. The sleeve is of a simple construction, uses a minimal amount of material and greatly increases the space available for displaying product information. Not only are planar surfaces created on the top, bottom and two side portions of the container for clearly displaying information, but the inside of the sleeve is also usable for providing information to be viewed by the purchaser after the sleeve is opened and the product removed. Furthermore, the sleeve prevents the container from being opened unless the sleeve is torn or cut, thereby assuring the consumer that the product has not been tampered with.

In accordance with the present invention, a unitary blank is provided which can be folded about a tub of a food product to provide additional display panels for product information. None of the panels come into contact with the food product and thus may be saved by the purchaser if they contain coupons or useful information. The sleeve formed from this blank may include openings therein so that the clear lid and the contents of the tub may be seen with the sleeve in place. Furthermore, the sleeve leaves portions of the side walls of the container visible so that consumers can see that the product is still being sold in a familiar tub. The design maximizes the amount of surface area available for displaying information without the waste that would be entailed by enclosing a tub within a separate box or carton.

It is therefore a principal object of the present invention to provide a blank for forming an improved sleeve for holding a tub-shaped container.

It is another object of the present invention to provide a sleeve for retaining a container which sleeve increases the surface area available for displaying product information.

It is a further object of the present invention to provide a sleeve for holding a container which sleeve leaves a portion of the container cover and thus a portion of the contents of the container visible.

It is yet another object of the present invention to provide a sleeve for holding a container which sleeve engages the container more tightly when the container is moved toward one of the open ends of the sleeve.

It is still another object of the present invention to provide a sleeve for holding a container which sleeve has a supplemental panel adapted to engage a lower corner of the container to enhance retention of the container in the sleeve.

It is another object of the present invention to provide a sleeve for holding a container which prevents the container from being opened until the sleeve is removed.

BRIEF DESCRIPTION OF THE DRAWINGS

The foregoing and other objects of the present invention will in part be obvious and in part be pointed out more fully hereinafter in connection with the written description of a preferred embodiment of the invention illustrated in the drawings in which:

FIG. 1 is a perspective view of a sleeve according to the present invention fastened about a container;

FIG. 2 is a perspective view, partly in section, showing the container in FIG. 1 without the sleeve;

DETAILED DESCRIPTION OF THE PREFERRED EMBODIMENT

Figure 5:
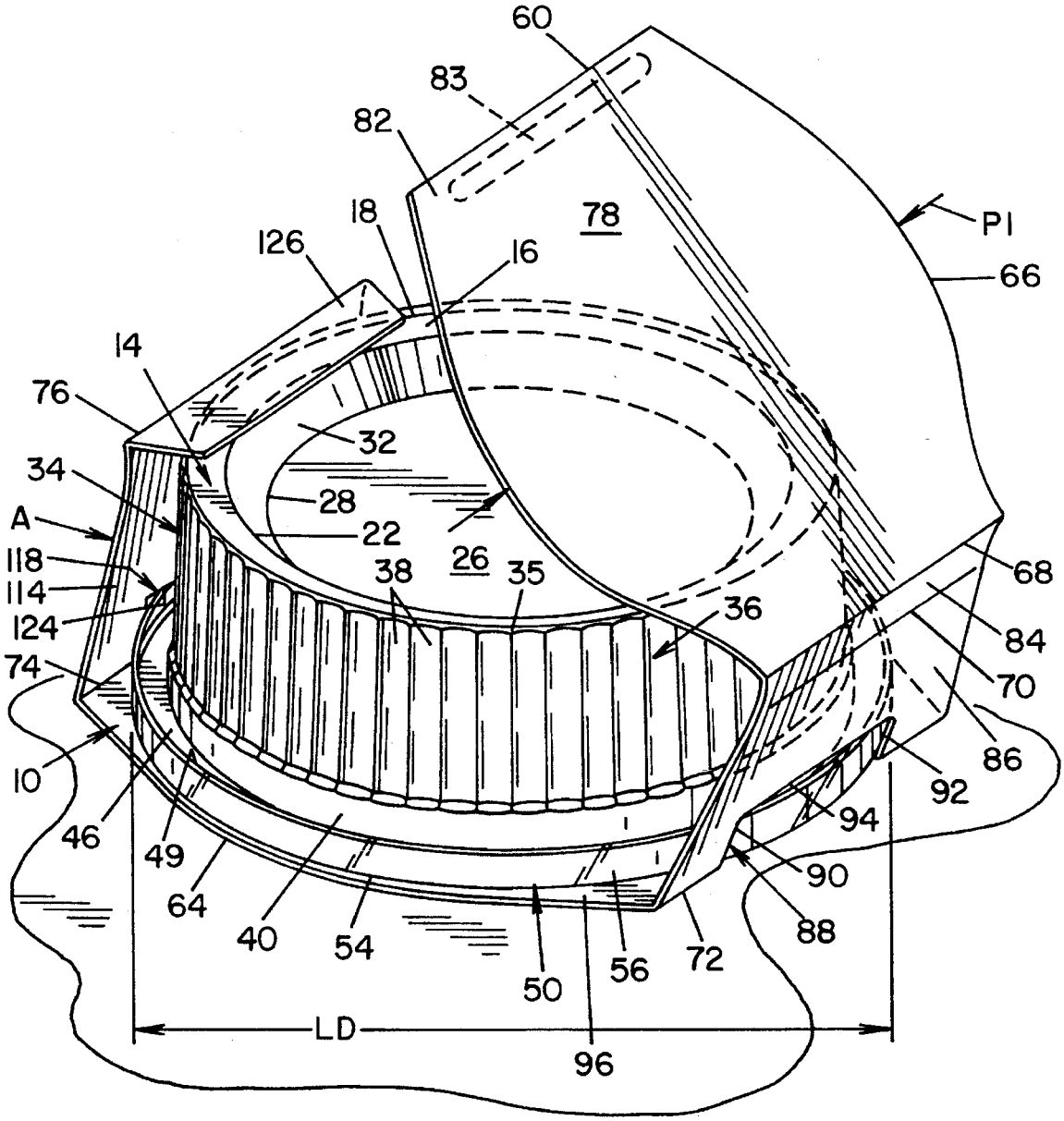
FIG. 5 is a perspective view showing the container inverted and the blank in FIG. 3 partially encircling the container before the ends of the blank have been fastened to form a sleeve in accordance with the present invention.

Referring now to the drawings wherein the showings are for the purpose of illustrating a preferred embodiment of the invention only and not for the purpose of limiting same, FIG. 1 shows a container or tub 10 retained within a sleeve which will be described in greater detail hereinafter. As best seen in FIGS. 2 and 5, tub 10 comprises a bottom wall 14 which includes an annular outer base portion 16 having an outer annular edge 18 defining an outer diameter for the bottom wall and an inner edge 22 defining an inner diameter for outer base portion 16. Bottom wall 14 further includes a central portion 26 having an edge 28. The diameter of central portion 26 is less than the inner diameter of annular outer portion 16. Annular portion 16 is connected to central portion 26 by an angled bottom wall portion 32 extending from the inner edge 22 of annular base 16 to the edge 28 of central bottom wall 26. As can best be seen in FIG. 2, this configuration results in a tub 10 with a bottom wall 14 having a raised, circular center portion. This construction contributes to the strength and rigidity of the tub. Tub 10 further includes a side wall 34 having a bottom edge 35 and extending generally vertically above and a short distance below outer edge 18 of annular portion 16. Wall 34 includes a fluted lower portion 36 having a plurality of flutes 38 and a slightly wider, smoother upper portion 40 terminating in an annular flange 42 which flange extends generally perpendicular to side wall 34 and generally parallel to annular portion 16. Flange 42 has a top side 44 and a bottom side 46 and an outer annular edge 48. Tub 10 further includes a lid 50 which may be transparent or opaque and which lid includes a circular top wall 52 having an outer annular edge 54 and an annular side wall 56 depending therefrom and an annular flange 49 extending inwardly from wall 56. The diameter of top wall 52 is slightly greater than the outer diameter of flange 42 thereby allowing lid 50 to fit over outer edge 48 of flange 42 with annular flange 49 engaging bottom side 46 of flange 42 to sealingly connect lid 50 to tub 10 in a well known manner.

Figure 3:
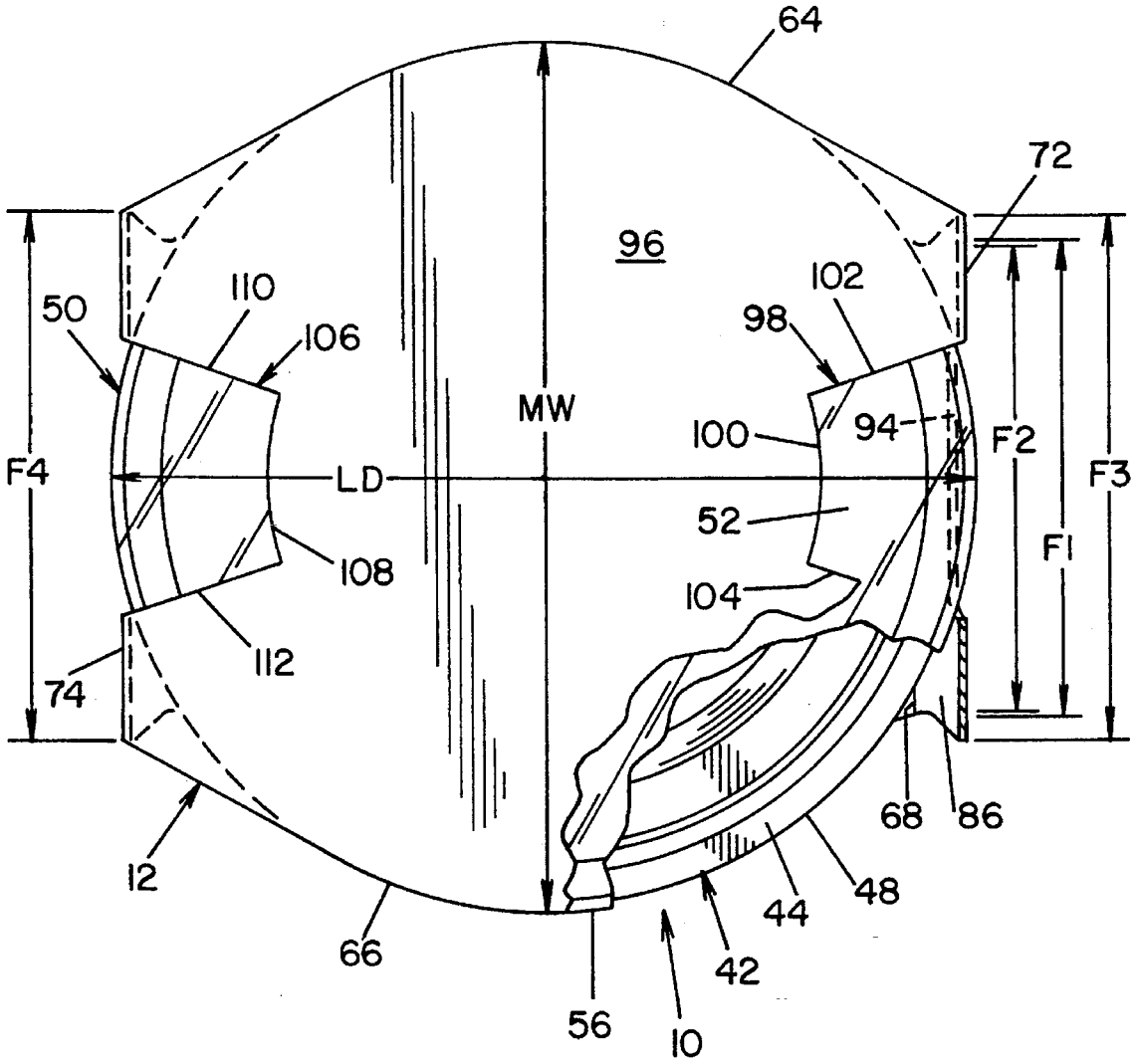
FIG. 3 is a top plan view of the sleeve and container in FIG. 1.
Figure 4:
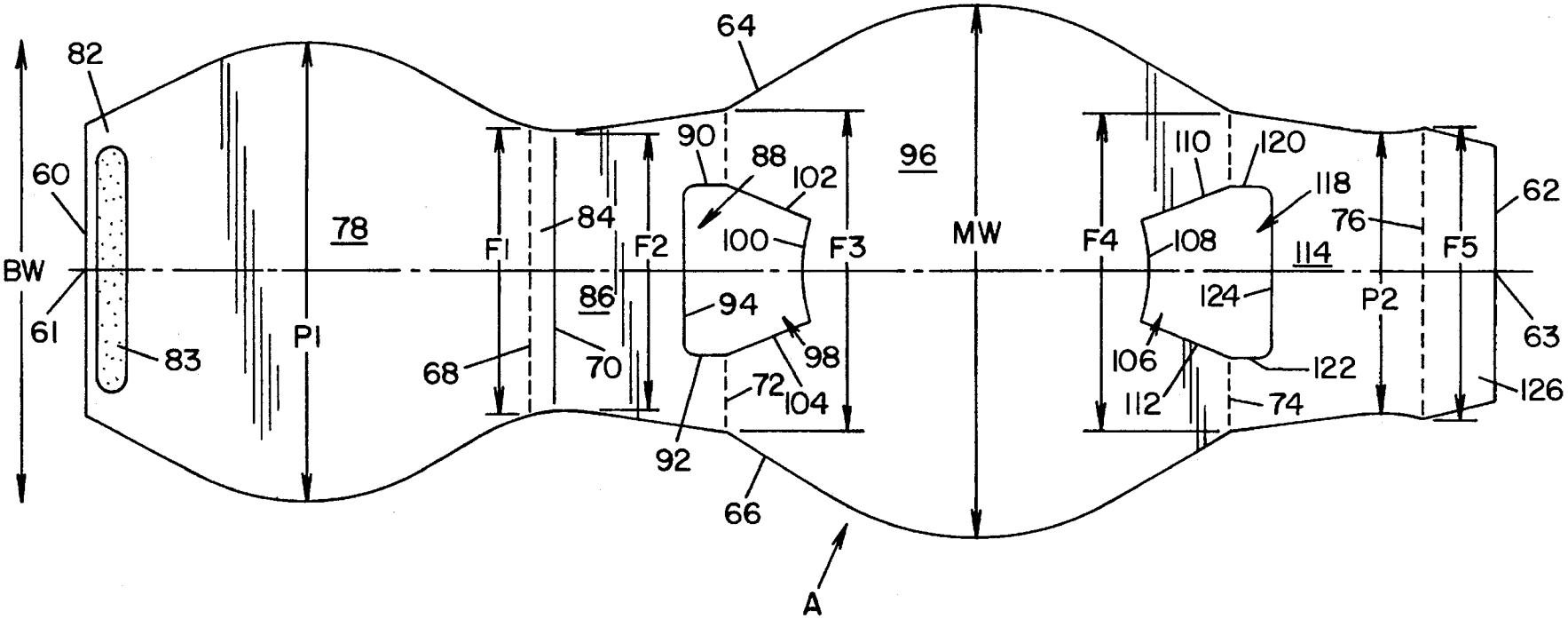
FIG. 4 is a plan view of a paperboard blank from which the sleeve of the subject invention is formed.

Sleeve 12 is formed from a sleeve blank A which, as best seen in FIG. 4, includes a left end edge 60 having a midpoint 61 and a right end edge 62 having a midpoint 63. The top and bottom ends of edges 60 and 62 are respectively connected by a top edge 64 and a bottom edge 66. Blank A is divided into six panels by a first fold line 68 having a width F1, a second fold line 70 having a width F2, a third fold line 72 having a width F3, a fourth fold line 74 having a width F4 and a fifth fold line 76 having a width F5. The six panels include a bottom panel 78 which is defined by left edge 60 and fold line 68 and the corresponding portions of top edge 64 and bottom edge 66, which edge portions are arcuate and curve away from each other between edge 60 and fold line 68 to provide a bottom panel width P1 therebetween. Bottom panel 78 further includes a glue receiving portion 82, the purpose of which will be described hereinafter. The second panel is a narrow strip portion 84 defined by fold lines 68 and 70, with the corresponding portions of top edge 64 and bottom edge 66 sloping gradually toward one another from fold line 68 toward fold line 70. The third panel is a first side panel 86 defined by fold lines 70 and 72 and the corresponding portions of top edge 64 and bottom edge 66 which slope gradually away from one another from fold line 70 toward fold line 72. First side panel 86 also includes a rectangular cutout 88 extending thereinto from fold line 72 and having a first edge 90 perpendicular to the fold lines, a second edge 92 parallel to first edge 90 and a third edge 94 extending between and perpendicular to edges 90 and 92. Cutout 88 is centrally located between edges 64 and 66. The fourth panel is a top panel 96 defined by fold line 72 and fold line 74 and the corresponding portions of top edge 64 and bottom edge 66. These edge portions are arcuate and curve away from one another between fold lines 72 and 74 to provide a maximum width MW at a point halfway between the fold lines. Top panel 96 has a first cutout 98 located centrally along fold line 72 and continuous with cutout 88 in first side panel 86. First cutout 98 comprises an arcuate inner edge 100 spaced from fold line 72 which is shorter than edge 94 of cutout 88. Edge 100 is connected to first edge 90 of cutout 88 by an angled edge 102 and to second edge 92 by an angled edge 104. Top panel 96 is symmetrical with respect to width MW and includes a second cutout 106 along fold line 74. Second cutout 106 includes an arcuate inner edge 108, a first edge 110 extending between edge 108 and fold line 74 and angled toward top edge 64, and a second edge 112 extending from edge 108 to fold line 74 and angled toward bottom edge 66. The fifth panel is a second side panel 114 defined by fold line 74 and fold line 76 and the corresponding portions of top edge 64 and bottom edge 66 which gradually converge in the direction from fold line 74 to fold line 76 to provide a minimum panel width P2 just before fold line 76. From minimum panel width P2, top edge 64 and bottom edge 66 diverge toward fold line 76. Second side panel 114 includes a cutout 118 having a first edge 120 perpendicular to the fold lines, a second edge 122 parallel to edge 120 and a third edge 124 extending between and perpendicular to the edges 120 and 122. Cutout 118 is continuous with second cutout 106 in top panel 96. The sixth panel is a glue flap 126 defined by fold line 76 and right end edge 62 of the blank. As described hereinafter, flap 126 is glued to glue receiving portion 82 of bottom panel 78 to form the sleeve 12 of the subject invention. The blank 12 is symmetrical about a line between the midpoint 61 of left edge 60 and the midpoint 63 of right end 62.

FIG. 5 shows the manner in which blank A is folded around tub 10 to provide sleeve 12. In this respect, blank A is placed on a flat surface and tub 10 is inverted and placed with lid 50 overlaying top panel 96. Glue 83 is applied to glue receiving portion 82, second side panel 114 is folded about fold line 74, to overlie side 34 of tub 10, and glue flap 126 is folded about fold line 76 so that the glue flap overlies a portion of annular portion 16 of the bottom wall of tub 10. First side panel 86 is then folded about fold line 72 so that it overlies side wall 34 opposite second side panel 114, and narrow strip portion 84 is folded at fold lines 68 and 70 so that bottom panel 78 overlies bottom 14 of tub 10 and strip portion 84 is disposed adjacent outer edge 18 of portion 16. Glue receiving portion 82 is then pressed down onto glue flap 126 to complete the formation of sleeve 12. The complete assembly is best seen in FIG. 1.

As will be appreciated from FIGS. 1, 3, 5 and 7 has diametrically opposite portions extending outwardly through cutouts 88 and 118 to hold tub 10 in sleeve 12. More particularly in this respect, lid 50 has a diameter LD which is greater than the width of top panel 96 between fold lines 72 and 74. Therefore, when sleeve 12 is wrapped around tub 10, diametrically opposed portions of annular side wall 56 and top wall 50 extend beyond top panel 96 of sleeve 12 and through the corresponding one of the cutouts 88 and 118 in side panels 86 and 114. Portions of top wall 52 are also visible through first cutout 98 and second cutout 106 in top panel 96 such that, if lid 50 is transparent, the contents of tub 10 can be seen when sleeve 12 is in place. Cutouts 88 and 106 are diametrically opposed, and each of these cutouts intersects an arc of approximately 30 degrees along side wall 56 of lid 50. Such an arc is large enough to engage securely, while small enough so that side wall 56 of lid 50 remains in proximity to side panels 86 and 144 of sleeve 12. Specifically, edge 90 of cutout 88 engages lid 50 at a point diametrically opposed to the point at which edge 122 of cutout 118 engages the lid, and edge 92 of cutout 88 engages lid 50 at a point diametrically opposed to the point at which edge 120 of cutout 118 engages the lid. Edges 90 and 92 are separated by an angle of at least 30 degrees as are edges 120 and 122. Maximum width MW of top panel 96 is generally equal to the diameter of lid 50. Top edge 64 and bottom edge 66 of sleeve 12 between fold lines 72 and 74 generally coincide with the curve of lid 50. In a similar manner, the maximum width P1 of bottom panel 78 is approximately equal to the diameter of annular portion 16 of bottom 14 while the portions of top edge 64 and bottom edge 66 between left edge 60 and fold line 68 generally conform to the shape of outer edge 18 of annular portion 16. The side wall 34 is also visible between bottom panel 78 and top panel 96.

Figure 6:
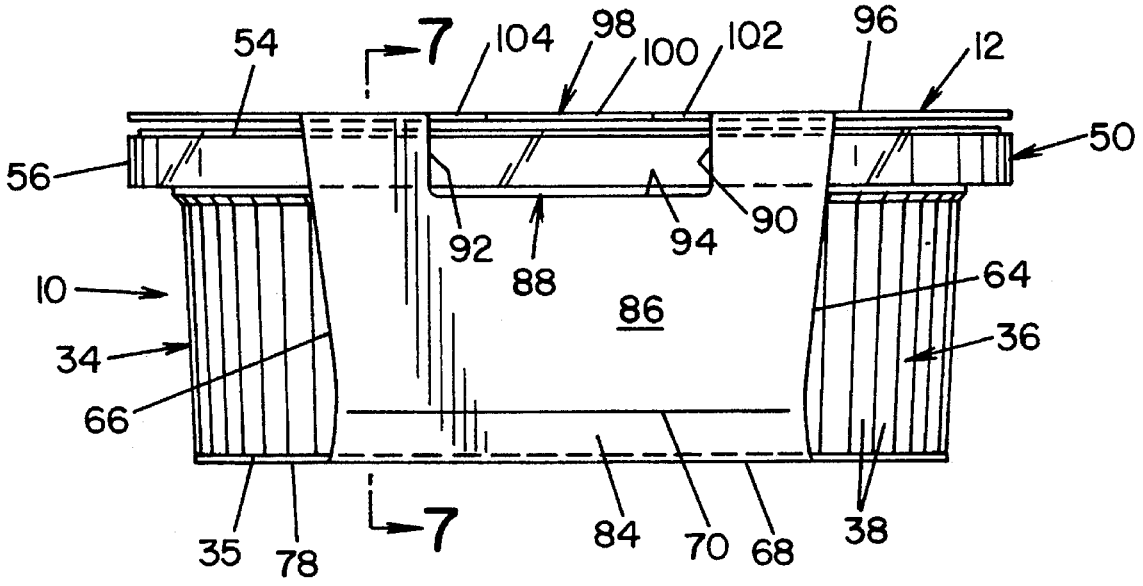
FIG. 6 is an end elevation view of the container and sleeve shown in FIG. 1.
Figure 7:
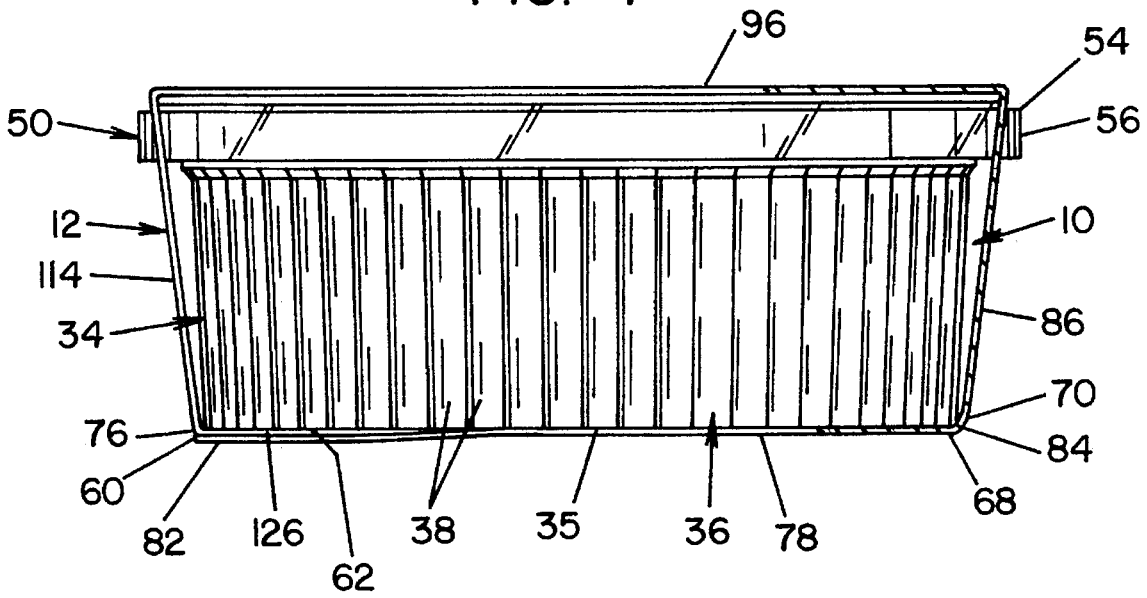
FIG. 7 is a sectional elevation view taken through line 6—6 in FIG. 5.
Figure 8:
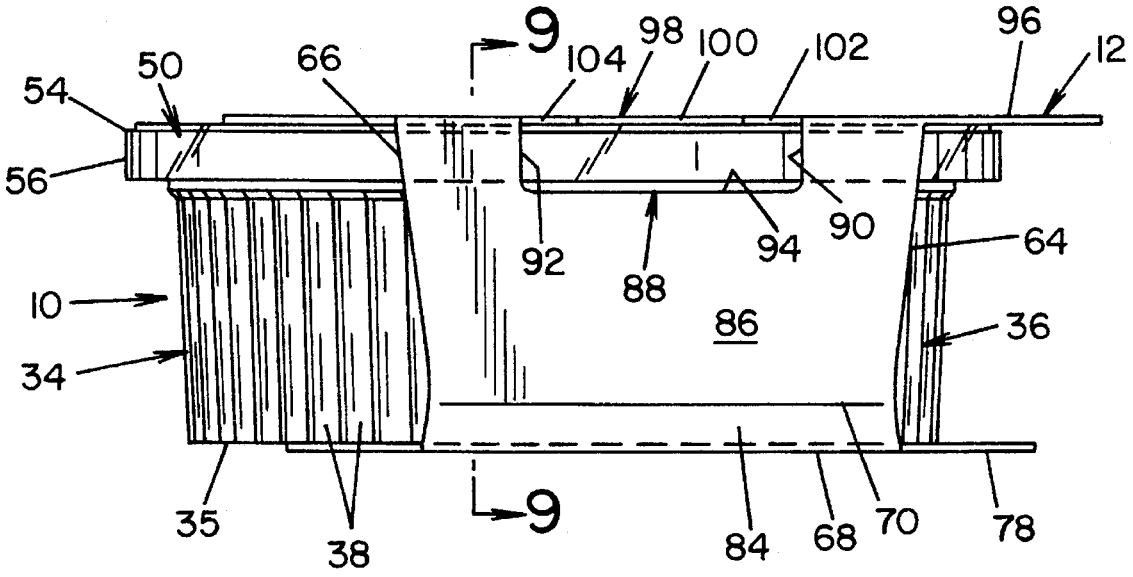
FIG. 8 is an end elevation view of the container and sleeve showing the container partially displaced from within the sleeve.
Figure 9:
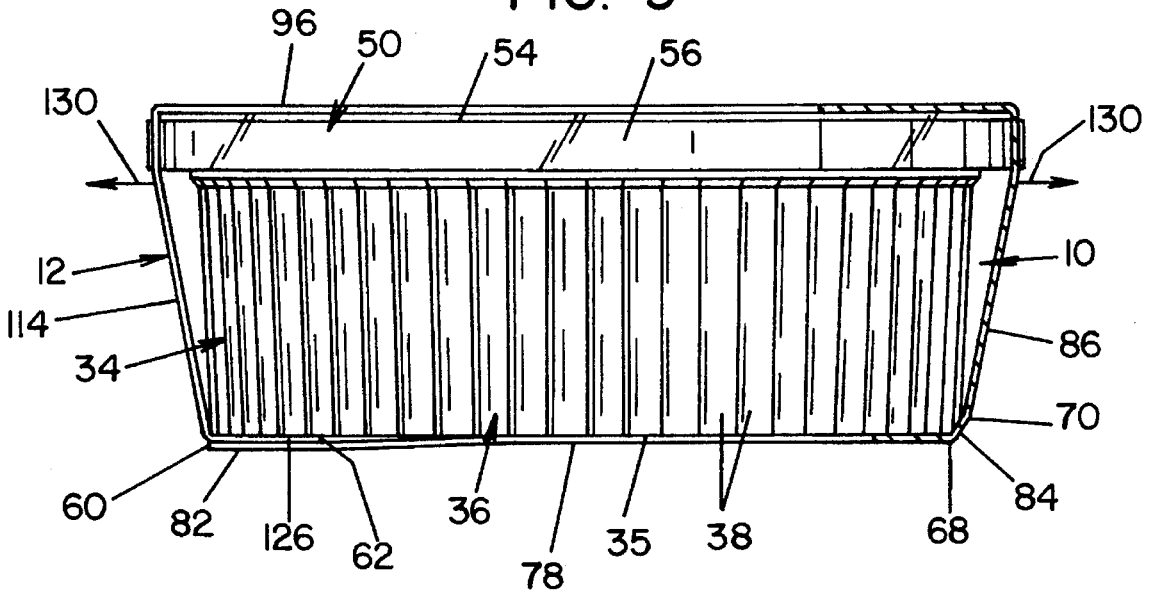
FIG. 9 is a sectional elevation view taken through line 8—8 in FIG. 7.

FIG. 6 is a side view of the subject tub and sleeve showing second side panel 86. FIG. 7 is a sectional view taken through line 7—7 in FIG. 6 showing the relationship between tub 10 and sleeve 12 when tub 10 is generally centered beneath top panel 96. As shown in FIG. 7, bottom edge 35 of side wall 34 defines a tub base having a diameter greater than the distance between end edge 60 and fold line 68. Thus, when sleeve 12 is in place around tub 10, diametrically opposite portions of bottom edge 35 are respectively adjacent fold line 76, side panel 114, and bottom panel 78, and between fold lines 68 and 70 and thus partially overlying narrow panel 84. If tub 10 is displaced relative to sleeve 12 in the direction of blank width BW, as shown in FIG. 8, edge 35 continues to be retained in the sleeve. In addition, such displacement causes sleeve 12 to hold lid 50 of tub 10 more tightly. In this respect, as will be appreciated from FIGS. 8 and 9, when lid 50 presses either in one direction against edges 90 and 120 or in the opposite direction against edges 92 and 122, as shown in FIG. 8, side panels 86 and 114 are pressed away from each other. In this respect, when tub 10 is displaced as shown in FIG. 8, the upper ends of panels 86 and 114 are forced apart in the directions shown by arrows 130 in FIG. 9. This forces bottom edge 35 of side wall 34 against the lower end of side panel 114 and against narrow strip portion 84, thus to tension sleeve 12 more tightly around tub 10. Therefore, it is necessary to cut or tear sleeve 12 in order to remove tub 10 therefrom. This assures prospective purchasers that the tub has not been opened or otherwise tampered with prior to purchase and provides sufficient freedom between the sleeve and tub to enable a purchaser to rotate the tub in the sleeve so that more of the contents of the tub can be viewed through cutouts 98 and 106 than would otherwise be possible.

The invention has been described with reference to a preferred embodiment and it is apparent that other embodiments as well as modifications of the preferred embodiment can be made without departing from the principles of the invention. According, it will be distinctly understood that the foregoing descriptive matter is to be interpreted merely as illustrative of the invention and not as a limitation.

I claim:

1. A container and a sleeve for holding said container, said container having a side wall including a generally circular top edge, a generally circular bottom wall, and a circular lid sealingly connected to said top edge, said sleeve having a top panel overlying said lid, a bottom panel completely underlying said bottom all, and opposed spaced apart first and second side panels between said top panel and said bottom panel, said first and second side panels including retaining means comprising openings in said first and second side panels for receiving diametrically opposed portions of said lid for retaining said container against displacement from said sleeve, and said top panel including openings continuous with and larger than said openings in said side panels for exposing a portion of said lid.

2. A container and a sleeve according to claim 1, wherein said retaining means further includes a planar, uninterrupted strip portion having a first side and a second side between said bottom panel and one of said side panels, said bottom wall and said side wall of said container including an annular edge therebetween disposed entirely to said first side of the plane of said strip portion and said strip portion engaging said annular edge.

3. A container and a sleeve for retaining said container, said container having a bottom wall, a side wall extending upwardly from said bottom wall and having a top edge defining a circular top opening and a circular lid sealingly engaging said top edge, said sleeve comprising a bottom panel completely underlying said bottom wall, a first side panel extending upwardly from said bottom panel adjacent said container side wall, said first side panel including a cutout receiving a first circumferential portion of said lid, a top panel connected to said first side panel and overlying said lid, a second side panel extending downwardly from said top panel adjacent said container side wall and having a cutout receiving a second circumferential portion of said lid diametrically opposite said first circumferential lid portion, and a glue flap for connecting said second side panel to said bottom panel, wherein said top panel includes a first opening continuous with and larger than said cutout in said first side panel and a second opening continuous with and larger than said cutout in said second side panel.

4. A container and a sleeve according to claim 3, wherein said top, bottom and first and second side panels are symmetrical with respect to a line bisecting said cutouts in said first and second side panels.

5. A container and sleeve according to claim 4, wherein said bottom wall is disposed entirely between said first side panel and said second side panel.

* * * * *